US005137786A

United States Patent [19]

Koshizuka et al.

[11] Patent Number: 5,137,786

[45] Date of Patent: * Aug. 11, 1992

[54] HEAT-SENSITIVE TRANSFER RECORDING MEDIUM

[75] Inventors: Kunihiro Koshizuka, Hino; Yoshihiro Inaba, Hachioji; Takao Abe, Tokyo; Tatsuichi Maehashi, Hachioji, all of Japan

[73] Assignee: Konica Corporation, Tokyo, Japan

[ * ] Notice: The portion of the term of this patent subsequent to Nov. 21, 2006 has been disclaimed.

[21] Appl. No.: 568,526

[22] Filed: Aug. 14, 1990

Related U.S. Application Data

[60] Continuation of Ser. No. 300,615, Jan. 23, 1989, abandoned, which is a division of Ser. No. 906,035, Sep. 10, 1986, Pat. No. 4,828,922.

[30] Foreign Application Priority Data

Sep. 18, 1985 [JP] Japan ..... 60-207594

[51] Int. Cl.[5] ..... B41M 5/26

[52] U.S. Cl. ..... 428/412; 428/195; 428/423.1; 428/480; 428/484; 428/488.1; 428/500; 428/522; 428/913; 428/914

[58] Field of Search ..... 428/195, 484, 488.1, 428/488.4, 913, 914, 412, 423.1, 480, 500, 522

[56] References Cited

U.S. PATENT DOCUMENTS

| | | | |
|---|---|---|---|
| 4,707,406 | 11/1987 | Inaba et al. | 428/484 |
| 4,756,950 | 7/1988 | Matsushita et al. | 428/484 |
| 4,882,218 | 11/1989 | Koshizuka et al. | 428/204 |

*Primary Examiner*—Pamela R. Schwartz

*Attorney, Agent, or Firm*—Frishauf, Holtz, Goodman & Woodward

[57] ABSTRACT

A heat sensitive transfer recording medium is disclosed, which is excellent in the heat-transferability onto a large variety of paper surface and is suitably usable for repetitive printings. The recording medium comprises a subbed support and a heat fusible coloring material layer which contains at least one compound having a plurality of polar groups and/or polar bonds selected from the group consisting of a hydroxyl group, an amino group, an imino group, a carboxyl group, an ester bond, an ether bond, an urethane bond and an amino bond.

9 Claims, No Drawings

HEAT-SENSITIVE TRANSFER RECORDING MEDIUM

This application is a continuation of application Ser. No. 07/300,615, filed Jan. 23, 1989 (now abandoned), which is a division of Ser. No. 06/906,035 filed Sep. 10, 1986, now U.S. Pat No. 4,828,922 issued May 9, 1989.

FIELD OF THE INVENTION

The present invention relates to a heat-sensitive transfer recording medium, and more particularly to a heat-sensitive transfer recording medium which is excellent in the heat-transferability onto a large variety of paper materials and which is suitably usable for repetitive printings.

BACKGROUND OF THE INVENTION

In the printing recording field. technological progress has recently been made in all phases from the impact recording system which uses conventional pressure-sensitive ribbons to the nonimpact recording system, and in the background of such progress there have been accomplishments of the following requirements:

1. Printer's cost reduction,
2. removal of printer noise, and
3. alleviation of the maintenance.

Among those nonimpact recording methods, the heat-sensitive transfer recording method attracts attention particularly in respect of being excellent not only in the above-mentioned requirements but also in the resulting image stability. reliability, and the like. However, it is also true that the existing heat-sensitive transfer recording methods are still not adequate.

The remaining most important question is the reduction of the running cost. Upon this, a demand has been made for the development of a heat-sensitive transfer recording medium which is repeatedly usable unlike conventional ribbons for only one time use.

Several techniques for this purpose have until now been disclosed which include those as described in Japanese Patent Publication Open to Public Inspection (hereinafter referred to as Japanese Patent O.P.I. publication) Nos. 68253/1979, 105579/1980, 16091/1982, 185192/1982, and the like. Those disclosed in these publications relate to techniques which enable the repetitive printing by how little thermofusible ink can be transferred.

That is, Japanese Patent O.P.I. Publication No. 68253/1979 discloses a method in which a volatile solvent is used to form a resin-component fine porous layer and from the resin component as a solid mother material an ink is thermally fused to be exuded. Japanese Patent O.P.I. Publication No. 105579/1980 discloses a method for the incorporation of a thermofusible ink into a heat-resistant ink layer having a fine porous reticular structure likewise, in which, for example, a polymer resistant against a temperature of more than 120° C. serves as a solid mother material. Japanese Patent O.P.I. Publication No. 160691/1982 describes a method in which an inorganic or organic fine powder (such as carbon black) is used as a solid mother material and from the material a solvent dye as a colored ink is exuded. And Japanese Patent O.P.I. Publication No. 18192/1982 discloses a method in which an ink-impregnated porous paper is used as a solid mother material and from the material the ink is thermally diffused to be exuded.

These techniques each is of an idea that a thermally exudable ink is made present in a porous solid mother material, whereby the ink is little by little exuded to be transferred therefrom. Such the idea is of the utilization of those pressure-sensitive carbon paper techniques as disclosed in, e.g., Japanese Patent Examined Publication No. 13426/1960, for heat-transferable carbon paper.

In the case of a heat-sensitive transfer, however, the presence of the solid mother material used for the purpose of little by little transferring an ink may become a different disadvantage at the same time; that is, the mother material is not substantially fused at the time of the application of energy, or is not mixed with a thermofusible low-melting material, and as a result, the solid mother material itself is substantially nontransferable, and the incorporation of such the nontransferable material in an ink layer causes the whole ink layer to be thick, thus leading to the deterioration of the sensitivity, deterioration of the transfer efficiency, lowering of the transferred image density, overload of the thermal head, or deterioration of the printing quality such as resolution.

It is therefore necessary to develop a repeatedly usable medium which uses no solid mother material and which is free from the above-mentioned disadvantages.

Firstly, the fundamental requirement for making the medium repeatedly usable is that both ink layer and support thereof must be so adequately adhesive that the whole ink of the ink layer can not be transferred at least at once.

Regarding this, formerly, in the pressure-sensitive sheet, and in recent years, also in the field of the heat-sensitive transfer process, those techniques for interposing an adhesion layer as disclosed in Japanese Patent O.P.I. Publication Nos. 68253/1979, 105579/1980, 36698/1982, 96992/1984, etc., have been used. These techniques can be technology for satisfying the fundamental requirement for providing an adequate adhesion between the ink layer and the support.

As aforementioned, however, unless a solid mother material is used to control the transferring amount of the ink, the interposition of an adhesion layer alone is not enough to control the transferring amount of the ink.

That is, only the incorporation of those fundamental materials as generally used in conventional one-time ribbons, including various coloring materials such as various waxes, carbon black. pigments, dyes, etc., low-softening resins, softening agents (oily or semi-solid materials such as castor oil, mineral oil, hydrogenated vegetable oil, lanolin, white vaseline, hydrophilic vaseline, etc.) and the like, in combination into the ink layer is not enough to properly control the transferring amount of the ink.

It is particularly difficult to make the medium repeatedly usable always at a high density according to the change in the surface smoothness of printing paper. For example, even if printing were made a large number of times on a highly smooth paper, in the case of a low-smooth-surface paper, it possibly occurs that the paper requires a large transferring amount of the ink in the first printing so that the printing density in the subsequent printings becomes extremely lowered. Or if an adjustment is made so as to conduct printing properly on a less smooth paper, in the case of a highly smooth paper, there occurs a problem that the transferring amount of the ink in the first printing is too small to obtain an adequate density. Further, there also occurs a problem that the density is low regardless of the smoothness, so that the printing quality is deteriorated.

SUMMARY OF THE INVENTION

It is therefore a first object of the present invention to provide a heat-sensitive transfer recording medium which enables the obtaining of a transferred image having a high density in a wide paper quality range of from high surface smoothness-having paper to low surface smoothness-having paper and which also enables numerous-time printings.

It is a second object of the present invention to provide a repeatedly printable heat-sensitive transfer recording medium which has a high sensitivity and a high resolution and which is excellent in the printing quality.

It is a third object of the present invention to provide a repeatedly printable heat-sensitive transfer recording medium whose ink layer's coating and producing cost is inexpensive.

The present invention has been made as a result of our continued investigation made noticing that the transferring amount of the ink strongly correlates with two parameters: the viscosity of the ink when it is fused and the aggregation breaking strength of the ink when it is not in fusion (when cooled).

That is, the above objects of this invention are accomplished by a heat sensitive transfer recording medium comprising a support having a subbing layer and a heat fusible colorant layer provided thereon which contains at least one compound having a plurality of polar groups and/or polar bonds selected from the group consisting of a hydroxyl group, an amino group which may be substituted, an imino group which may be substituted, a carboxyl group and its salt, an ester bond, an ether bond, an urethane bond and an amido bond. This group of the compounds are termed Group-A compounds hereafter.

DETAILED DESCRIPTION OF THE INVENTION

There are still many not-clear points in the reason why surprising effects are displayed by the construction of this invention, but, in the case where the foregoing two parameters of the ink layer are properly designed, the ink in a high concentration peels off little by little in order from the topmost part of the ink layer, and the dependency of the transferring amount of the ink upon the surface smoothness of printing paper can be minimized. This is considered to imply that the transferring amount of the ink is determined by the the wet area (the contacted area with printing paper) due to the viscosity of the ink when it is fused and the aggregation breaking strength of the ink when it is not in fusion and the related mechanical balance in peeling off the ink sheet. As has been mentioned in the description of conventional techniques, the combined use of general materials alone, although it may enable the viscosity alone to fall under its optimum range, is not enough to weaken and make the aggregation strength optimum.

For example, even if softening agents such as a low-melting resin and/or a semi-solid material are incorporated in combination into the ink layer, because they are unable to adequately weaken the aggregation strength, the whole ink layer is transferred at a time onto a printing sheet. As a result of our continued investigation, it has now been found that the adequately weakening of the aggregation strength of the ink layer without impairing the necessary and minimum layer formability and at the same time with retaining the adhesion strength thereof with the adhesion layer can be carried out only by the incorporation of relatively-low-polar waxes and polar materials which are such as Group-A compounds and specially miscible with such waxes in combination into the ink layer.

That is, the aggregation strength is attributable to the intermolecular interaction of the compounds contained in the ink layer. Accordingly, the magnitude of the aggregation strength is considered to vary according to the kind and number of polar groups in the molecule or, macroscopically, to the presence of the sea-island system based on the immiscibility of the compounds with one another. In the present invention, the control of the aggregation strength is carried out by a combination of the foregoing waxes with Group-A compounds.

One of advantages of the present invention is that the ink layer can be hot-melt coated.

Where a solid mother material is contained or not contained in the ink layer, if such a wax and a resin immiscible with the wax are used, it is indispensable to use a volatile solvent in the coating. However, the use of a volatile solvent not only causes social problems such as environmental pollutions but also increases the production cost, thus resulting in the obstruction to the reduction of the running cost which is the essential object of this invention. The construction of this invention enables the hot-melt coating of the ink layer to keep the production cost inexpensive.

The present invention will be illustrated more in detail below:

In the present invention, the thermofusible material constituting a thermofusible coloring material layer comprises in combination relatively-low-polar waxes and high-polar Group-A compounds.

The above relatively-low-polar waxes include animal, vegetable, mineral, petroleum-type, metamorphic-type and synthetic hydrocarbon-type waxes, which are the materials of a melting point of not more than 100° C. (measured by Yanagimoto Model MPJ-2), and preferably of a melting point of from 40° to 80° C. To be concrete, the following waxes may be used.

The animal waxes include beeswax, insect wax, shellac wax, spermaceti, wool wax, etc., the vegetable waxes include carnauba wax, Japan wax, auriculae wax, esparto wax, candelilla wax, etc., the mineral waxes include montan wax, ozokerite, ceresin, etc., the petroleum-type waxes include paraffin wax, microcrystalline wax, ester wax, petrolactam, etc., the metamorphic-type waxes include oxidized wax, montan wax derivatives, paraffin or microcrystalline wax derivatives, etc., the synthetic hydrocarbon-type waxes include Fischer-Tropsch wax, polyethylene wax, low-molecular polyethylenes and derivatives thereof, and the like. These may be used alone or in combination of two or more. In addition, in this invention, different other waxes such as castor wax, opal wax, etc., may also be used in combination with these waxes.

Such waxes are desirable to be used as a continuous binder in the ink layer.

The Group-A compound of this invention is a compound having inside the molecule thereof at least two polar groups, at least two polar bonds, or at least two complexes of them. In a compound having only one polar portion in the molecule thereof, no such effects as previously mentioned can be expected. This is considered due to the fact that the compatible condition due to the compound's miscibility with the wax results in no adequate weakening of the aggregation strength of the ink layer or on the contrary the increase in the aggregation strength.

According to our investigation, examples of the preferred polar group to be contained in the plural inside the molecule include hydroxyl group (—OH), amino groups (including substituted amino groups: —$NH_2$, —NHR, wherein R is a substituent). imino groups (including substituted imino groups: =NH, =NR, wherein R is a substituent), and carboxyl groups (including salts thereof: —COOH, —COOM, wherein M is an alkali metal or a basic component such as $NH_4$); and examples of the polar bond include ester bond (—COO—), ether bond (—O—), amido bond (—CONH—), and urethane bond (—NHCOO—).

Since this invention aims at weakening the aggregation breaking strength of the ink layer to an optimum extent by the incorporation of waxes and Group-A compounds in combination into the ink layer, the use of a compound, even if the above-mentioned polar portion is provided inside the molecule thereof, if it increases the aggregation strength of the ink layer to the contrary, is not effective. For example, it has been found that a certain polymer, where the weight average molecular weight thereof is excessively large, increases the aggregation strength of the ink layer, thus being unable to display the effect of this invention.

The Group-A compounds of this invention will be illustrated in detail below by broadly classifying them into three types for convenience' sake:

(a) Compounds containing a plurality of polar groups, (b) compounds containing a plurality of polar bonds, and (c) polymers having a polar portion.

However, the Group-A compounds of this invention are not limited to the above because there also exist of course those complex compounds consisting of the above (a) and (b), those polymers which belong to (a) or (b), and the like. With these as the fundamental structure, further a benzene nucleus, saturated hydrocarbon ring, saturated or unsaturated hydrocarbon group, halogen atom, sulfur atom, nitrogen atom, etc., may be incorporated in combination into the molecule.

(a) Compounds Containing a Plurality of Polar Groups

Polyhydric alcohols, polyamines, polybasic acids, oxy acids, amino acids, aminoalcohols, and the like, belong to such compounds.

The preferred polyhydric alcohols are those of a molecular weight of from 40 to 2,000, having a melting point of preferably from 40° to 120° C., and more preferably from 40° to 90° C. Suitable examples of the polyhydric alcohols include glycerol, pentaerythritol, mannitol, sorbitol, sorbitan, batyl alcohol, alkylene glycols (such as ethylene glycol, propylene glycol, decamethylene glycol, etc.; those having from 2 to 10 carbon atoms are preferred because, if the alkyl chain is too long, the polarity becomes weakened), and the like. And homopolymers of these polyhydric alcohols, such as polyglycerol, polypentaerythritol, polyalkylene glycol, etc., may also be used (even if the weight average molecular weight becomes larger, it will not increase the aggregation strength, but the weight average molecular weight is preferably not more than 20,000, and more preferably not more than 10,000 from the standpoint of the viscosity).

The foregoing polyamines are those having a molecular weight of preferably from 50 to 2,000, and more preferably from 60 to 1,000 and having a melting point of from 40° to 120° C.

Useful examples Of the polyamines include straight-chain or side-chain-type aliphatic diamines (the number of the carbon atoms of the alkyl portion is desirable to be from 6 to 30; such as, e.g., hexamethylenediamine, decamethylenediamine, etc.). polyalkylenepolyamines [such as triethylenetetramine, N-(4-aminobutyl)cadaverine, spermine, 1-(2-aminoethyl)piperazine, etc.], and the like.

The foregoing polybasic acids (polycarboxylic acids), although they have generally high melting points, are those of a melting point of preferably from 40° to 140° C., and of a molecular weight of preferably not more than 10,000 and more preferably from 60 to 2,000.

Useful examples of the polybasic acids include saturated dicarboxylic acids (such as glutaric acid, α-methylsuccinic acid, α-methylglutaric acid, eicosanedicarboxylic acid, etc.), unsaturated dicarboxylic acids (such as itaconic acid, fumaric acid, etc.), tricarboxylic acids (such as propane-1,2,3-tricarboxylic acid), aromatic and heterocyclic dicarboxylic acids (such as p-phthalic acid, 1-methylpyrrol-2,5-dipropionic acid, etc.), and the like.

The preferred compounds containing a plurality of different polar groups are those having a molecular weight of from 60 to 2,000 and a melting point of from 40° to 120° C.

Useful examples of the compounds include oxy acids (such as citric acid, malic acid, etc.), amino acids (such as glutamic acid, lysine, aspartic acid, etc.), aminoalcohol (such as diethanolamine, triisopropanol, 1-amino-5-pentanol, etc.), and the like. It is of course possible for the compound to contain three groups; hydroxyl, amino or imino, and carboxyl groups, in the same molecule thereof.

(b) Compounds Containing a Plurality of Polar Bonds

They are compounds containing two or more bond portions (allowed to be either the same or different) selected from the class consisting of the ester bond, ether bond, urethane bond and amido bond, and, in this invention, they also include those complex compounds containing at least one of the above bonds and at least one of the polar groups mentioned in (a). The latter is convenient because such the complex compound can be obtained by using part or the whole of the polar groups of a compound containing a plurality of polar groups as defined in (a) to derive therefrom ester, ether, urethane, and amido bonds. The preferred compounds are those having a molecular weight or weight average molecular weight of from 60 to 2,000 and a melting point of from 40° to 120° C., and preferably from 50° to 80° C.

Useful examples of (b) derived from (a) will be illustrated by the construction below, but the present invention is not restricted by the examples.

(i) Ester Bond Derivatives

There are two ways: one is where an ester bond is provided by the reaction between the hydroxyl group-having polyhydric alcohol, oxy acid, or aminoalcohol of (a) and a carboxyl group-having compound, and the other where an ester bond is provided by the reaction between the carboxyl group(or a metallic salt thereof)-having polybasic acid, oxy acid, or amino acid of (a) and an alcoholic hydroxyl group-having compound.

As the carboxyl group-having compound in the former, those having not less than 10 carbon atoms, particularly those higher fatty acids having from 19 to 50 carbon atoms are preferred, which include, for example, decanoic acid, tridecanoic acid, palmitic acid, stearic acid, nonadecanoic acid, behenic acid, lignoceric acid, and the like. However, those other then the above, such as straight-chain monoenic salts, di-, tri- and tetraenic acids, tertiary fatty acids, branched-chain fatty acids, dimeric acids, amino acids, oxycarboxylic acids, polybasic acids, fatty acid chlorides and fatty acid anhydrides may also be used.

Many of the obtained ester-bond derivatives are mixtures of various isomers, mono- di- tri- tetra- or upward poly-ester bond derivatives, but these may be used intact. The preparation of such the ester-bond derivative may also be made by a method of interchanging esters, etc., regardless of the synthetic method therefor.

As the alcoholic hydroxyl group-containing compound in the latter, those having not less than 10 carbon atoms, particularly those higher aliphatic alcohols having from 19 to 50 carbon atoms are preferred, and other polyhydric alcohols, unsaturated higher alcohols, oxy acids, aminoalcohols, or those as caprolactone to ring-open to function as an alcohol may also be preferred.

The following are typical examples of the ester-bond derivatives:

- Propylene glycol monomyristate,
- Monoglyceride stearate,
- Diglyceride laurate,
- Sorbitan monobehenate,
- Polycarboxylic fatty acid esters of polyglycerol,
- Polypropylene glycol monobehenate,
- Pentaerythritol distearate,
- Mannitol monooleate-monostearate,
- Sorbitol tristearate,
- Batyl alcohol monolaurate,
- Distearyl terephthalate,
- Didodecyl dodecanoate, and
- Polyethylene glycol dipalmitate.

(ii) Ether-bond Derivatives

The ether-bond derivatives of this invention are those compounds having in the molecule thereof an ether bond and the foregoing polar group or polar bond. The preparation of the derivative is made by utilizing the hydroxyl group of the polyhydric alcohol, oxy acid or aminoalcohol of (a) to derive therefrom an ether bond. They include alkyl ethers, alkaryl ethers, aryl ethers, and the like. In this instance, the number of carbon atoms is preferably not less than 6, and particularly preferably from 19 to 50. Examples of the derivatives include those of the structure, ether-linked with a higher aliphatic alcohol such as behenyl alcohol, stearyl alcohol, oleyl alcohol, etc., or of the structure ether-bonded with phenol or an alkyl phenol, and the like. In addition, those of the structure ether-bonded with a polyhydric alcohol such as cholesterol, phytosterol, etc., and further those of the structure ether-bonded with the same and/or different, single or a plurality of the above polyhydric alcohols may also be used.

The following are examples representative of the ether-bond derivatives:

- Propylene glycol-stearyl ether,
- Polypropylene glycol-dibehenyl ether,
- Sorbitan-phytosterol ether,
- Glycerol-monostearyl ether,
- Polyglycerol-polybehenyl ether,
- Pentaerythritol-cholesterol ether.
- Di(4-carboxypropyl) ether,
- Ethylene glycol-monostearyl ether, and
- Decamethylene glycol-lauryl ether tridecanoate.

(iii) Amido-bond Derivatives

The amido-bond derivatives of the present invention are those compounds having inside the molecule thereof an amido bond and the foregoing polar group or polar bond. The carboxyl or amino group of the polycarboxylic acid, polyamine, amino acid or amino alcohol of (a) is made react with an amino group or carboxyl group, respectively, to thereby derive an amido bond therefrom.

The carboxylic acid to react with the amino group of the polyamine, aminoalcohol or amino acid is a higher fatty acid having preferably from 10 to 50 carbon atoms, and more preferably from 19 to 45 carbon atoms, and as the carboxylic acid, those various acids described in (i) may be used.

The amine to be used to react with the carboxyl group of the polycarboxylic acid, oxy acid or amino acid is desirable to be a higher aliphatic amine having from 7 to 50 carbon atoms, and aside from this, other unsaturated amines, secondary or tertiary amines, aromatic amines, amino acids, polyamines, aminoalcohols, and the like may also be used.

The following are examples representative of the amido-bond derivatives:

- $H_2N(CH_2)_4NH(CH_2)_5NHCOC_{18}H_{37}$,
- Tetramethylenediamine didodecanamide,
- Propionic acid-3-hydroxypropylamine,
- Terephthalic acid diamylamide,
- Pentamethylenediamine distearylamide,
- Propane-1,2,3-tricarboxylic acid monooctadecylamide, and
- $H_2N(CH_2)_2S(CH_2)_2NHCOC_{18}H_{37}$.

(iv) Urethane-bond Derivatives

The urethane-bond derivatives of this invention are those compounds having inside the molecule thereof an urethane bond and the foregoing polar group or polar bond. The hydroxyl group of the polyhydric alcohol, oxy acid or aminoalcohol of (a) is made react with an isocyanate group to thereby derive an urethan bond therefrom.

The isocyanate to be used for the reaction is a higher aliphatic isocyanate having preferably from 6 to 50 carbon atoms, and more preferably from 10 to 50 carbon atoms, and in addition, polyisocyanates, unsaturated isocyanates, aromatic isocyanates, halogen-containing isocyanates, and the like may also be used.

The following are examples representative of the urethane-bond derivatives:

- $C_{18}H_{37}NHCOOCH_2CH(OH)CH_2OH$,
- $C_2H_5CONH(CH_2)_4NHCOO(CH_2)_6OH$,
- $H_2N(CH_2)_6NHCOO(CH_2)_4OCOC_{17}H_{35}$, and
- $C_{12}H_{25}NHCOOCH_2CH_2OH$.

(c) Polymers Having a Polar Portion

In the present invention, the polymers having a polar portion are those straight-chain (having no three-dimensional structure) polyester, polyamide, polyurethane and vinyl-type polymers.

In these polymers, however, even if they have in the molecule thereof a number of polar portions, there are cases where on the contrary they increases the aggregation strength inside the ink layer. Accordingly, the polymer to be used is required to have a softening point of not more than 100° C. and a weight average molecular weight of not more than 9,000, preferably not more than 5,000, and more preferably not more than 2,000.

(i) Straight-Chain Polyesters

The straight-chain polyesters of this invention are those polymers having no three-dimensional structure and having on the main chain thereof two or more ester bonds. They can be obtained generally by the polymerization reaction of dibasic acids with glycols or by the ring-opening polymerization reaction of lactone-type compounds.

The following are examples representative of the straight-chain polyesters (the Mw below stands for weight average molecular weight).

Sebacic acid-decamethylene glycol copolymer (Mw 3,000, mp 74° C.),

Adipic acid-propylene glycol copolymer (Mw 3,000, mp 50° C.),

ω-hydroxydecanoic acid polyer (Mw 4,000, mp 75° C.),

δ-valerolactone polymer (Mw 2,000, mp 54° C.), and

ω-caprolactone polymer (Mw 4,000, mp 55° C.).

The ω-caprolactone polymer is commercially available in the trade names of Placcell 240, 260, 280 and H-I (Daicell Chemical Co., Ltd.)

The polymer to be used may be a compound having inside the molecule thereof such the polyester in the block or graft form, or having a terminal group such as an alkyl or amido group, or having a single or a plurality of hydroxyl groups, amino groups, carboxyl groups or carbonyl groups, or having on the main chain or side chain thereof a partial ether bond, amido bond or urethane bond.

(ii) Straight-Chain Polyamides

The straight-chain polyamides of this invention are those polymers having no dimensional structure and having on the main chain thereof a plurality of amido bonds. They can be obtained generally by the polymerization reaction between dibasic acids and diamines, by the self-condensation reaction of ω-amino acids, or by the ring-opening polymerization reaction of lactam-type compounds.

Keeping the melting point of the straight-chain polyamide down below 100° C. can be carried out (1) by reducing the polymer's weight average molecular weight (to preferably not more than 2,000), (2) in the case of the same weight average molecular weight, by increasing the monomer's molecular weight and reducing the polymerization degree (to preferably not more than 20), or (3) by the N-alkylation of the polyamide portion. Of these, the N-alkylation can be accomplished by mixing an N-alkyl or N,N'-dialkyldiamine with the diamine to be polymerized with a dibasic acid or by using a ω-N-alkylamino acid corresponding to ω-amino acid.

Examples of the polymer include, for example, ω-N-methylaminoundecanoic acid polymers (mp 60° C. Mw about 5,000), some of which can be commercially available in, e.g., HT-W series of Sanwa Chemical Co., Ltd.

The polymer may also be a compound containing inside the molecule thereof such the polyamide in the block or graft form, or may be one having a terminal group such as an alkyl or amino group or having a hydroxyl, amino, carboxyl or carbonyl group, or may also be one having in the main chain or side chain thereof a partial ether bond, ester bond or urethane bond.

(iii) Straight-Chain Polyurethanes

The straight-chain polyurethanes are those polymers having no three-dimensional structure and having a plurality of urethane bonds on the main chain thereof. In general, they can be obtained by the polyaddition reaction of diisocyanates with glycols, but may also be synthesized by various methods such as condensation reaction and the like.

Examples of the polymer include, e.g., the polycondensation product of hexamethylene diisocyanate and hexane-2,5-diol (Mw about 1,200, mp 86° C.).

Group-A compounds of this invention differ in the miscibility with waxes according to the combination thereof. This miscibility will be further explained. In the case where the miscibility with liquid paraffin (for example, where the concentration of Group-A compounds is 10% by weight) is used as the value representative of the miscibility with waxes, the compounds can be classified into the following three types:

(a) those immiscible with liquid paraffin at any temperature, (b) those miscible with liquid paraffin at 40° C. or above but not miscible at less than 40° C., and (c) those miscible with liquid paraffin at any temperature. The compounds to be used in this invention are desirable to be (a) and (b), taking into account the repetitive printability and productivity, but those defined in (c) also have a little functional effect.

In the present invention, the incorporation of a low-softening resin into the ink layer is very advantageous for the control of the viscosity and aggregation strength.

As the low-softening resin, in order to prevent the lowering of the sensitivity, those polymers whose softening point is less than 110° C. (ring and ball method) are preferred. In this invention, the resin component need not function as the solid mother material (non-transferable) and is desirable to be miscible with waxes and also to be used in a small adding quantity. The preferred adding quantity is 1 to 20% by weight of the whole ink layer. That waxes as the binder have miscibility is advantageous for accomplishing the nonsolvent coating of the ink layer, which is one of the objects of this invention.

Concrete examples include ethylene polymers such as polyethylene, α-olefin polymers and copolymers such as polypropylene, polystyrene, styrene-butadiene copolymers, styrene-isoprene copolymers, rubbers such as polybutadiene, and the like.

The subbing layer of this invention is a layer which is on the support and functions to stiffen the adhesion between the support and the ink layer (coloring material layer).

In order to enable the repetitive printing to be made stably on any kind of printing paper, which is one of the objects of this invention, the adequate adhesion between the support and the ink layer is the essential requirement.

The ink layer, as a whole, is relatively lacking in the polarity, while the support (generally, polyethylene terephthalate) is relatively strong in the polarity, so that the present invention cannot be accomplished without the subbing layer. Thus, the subbing layer plays an important part, but according to our investigation, even though the adhesion appears to be adequate, the ink transferring amount differs according to the adhesion strength, so that selection of the subbing layer suitable for both support and ink layer is essential.

In order to have the subbing layer display its function adequately, the subbing layer should be comprised of a resin component or comprised mainly of a resin.

Whether the adhesion strength is adequate or not, since it is determined by the balance with the aggregation strength of the ink layer on the subbing layer, cannot be expressed unconditionally. That is, in order to make possible the repetitive printing, it is necessary for the support/ink layer adhesion strength to at the lowest exceed the aggregation strength of the ink layer, and such the mechanical balance varies according to the manner of peeling the ink ribbon apart from printing paper and also to the temperature at the time of the peeling. The adhesion strength is to be ascertained by a 'peeling testing' method in which an adhesive tape applied onto the ink layer is peeled off.

The softening point of the subbing layer of this invention is preferably at least 50° C., and more preferably not less than 70° C. The thermal conductivity of the subbing layer is desirable to be high.

The thickness of the subbing layer is desirable to be as much thin as possible as long as its adhesion strength is adequate, and is preferably from 0.05 to 6 μm, and particularly preferably from 0.3 to 3 μm.

For the coating of the subbing layer, for example, the gravure coating, extrusion coating, roll coating, wire-bar coating, dip coating and the like methods can be used. The form of the coating liquid may be selected from those including the hot melt conventionally known for the coating of resinous material, aqueous solution, latex solution, and organic solvent solution.

The resin to be used in the subbing layer may be either thermosoftening or thermosetting one, whose preferred examples include acryl resin, ethylene-vinyl acetate resin, vinyl acetate resin, polyurethane resin, phenoxy resin, polyvinyl butyral resin, polycarbonate resin, polyester resin, ethyleneethyl acrylate resin, epoxy resin, and the like, but are not limited thereto. These resins are desirable to be used in combination of two or more.

Into the subbing layer may be mixed coloring materials, thermofusible materials, inorganic or organic powdery materials, and the like. In this instance, however, the adhesion strength must be prevented from being deteriorated. The resin content of the subbing layer, although dependent on the combination of the resin and the material to be mixed therewith, is preferably not less than 30% by weight, and more preferably not less than 50%.

In order to strengthen especially the adhesion strength, the subbing layer is desirable to contain at least one resin selected from the class consisting of the polyurethane, phenoxy, polyester and polycarbonate resins and at least one selected from the vinyl acetate-type copolymers and acrylate-type copolymers.

The coloring material to be used in the thermofusible coloring material layer may be arbitrarily selected from among various dyes, and preferably from those including direct dyes, acid dyes, basic dyes, disperse dyes, oil-soluble dyes (including metal-containing oil-soluble dyes), and the like. The dye to be used in the coloring material layer of this invention is allowed to be any coloring material as long as it is transferable along with a thermofusible material, so that, in addition to the above, pigments may also be used. To be concrete, the following may be used: Suitably usable yellow dyes include Kayalon Polyester Right Yellow 5G-S (Nippon Kayaku K.K.), Oil Yellow (Hakudo K.K.), Eizenspilon Yellow GRH (Hodogaya Chemical Co., Ltd.), and the like. Suitably usable red dyes include Diacelliton Fast Red R, Dianix Brilliant Red BS-E (Mitsubishi Chemical Industries, Ltd.), Sumiplast Red FB, Sumiplast Red HFG (Sumitomo Chemical Co., Ltd.), Kayalon Polyester Pink RCL-E (Nippon Kayaku K.K.), Eisenspilon Red GEH Special (Hodogaya Chemical Co., Ltd.), and the like. Suitably usable blue dyes include Diacelliton Fast Brilliant Blue R, Dianix Blue EB-E (Mitsubishi Chemical Industries, Ltd.), Kayalon Polyester Blue BSF Conc (Nippon Kayaku K.K.), Sumiplast Blue 3R, Sumiplast Blue G (Sumitomo Chemical Co., Ltd.), and the like. Further, those photographic dyes such as indoaniline dyes and azomethine dyes may also be suitably used. Useful yellow pigments include Hansa Yellow 3G, Tartrazine Lake, and the like. Useful red pigments include Brilliant Carmine FB-Pure, Brilliant Carmine 6B (Sanyo Shikiso K.K.), Alizarin Lake, and the like. Useful blue pigments include Sumikaprint Cyanine Blue GN-O (Sumitomo Chemical Co., Ltd.), Cerulean Blue, Phthalocyanine Blue, and the like. Useful black pigments include carbon black, oil black and the like. Among these coloring agents usable in this invention, the most useful one is carbon black.

EXAMPLES

The present invention will be illustrated in detail by the following examples, but the invention is not limited thereto. In addition, the term 'part(s)' used hereinafter means 'part(s) by weight.'

EXAMPLE 1

On a 5.6 μm-thick polyethylene terephthalate film support was formed a subbing layer having a dry thickness of 1.0 μm by wire-bar coating a solution of a mixture of polyurethane (N-2301, produced by Nippon Polyurethane K.K.) with ethyleneethyl acrylate resin (NUC-6070, produced by Nippon Unicar) in a proportion of 3:1, and on this, after drying, was wire-bar coated the following coloring material layer-coating liquids (disperse liquids prepared by using a dissolver) so that its dry thickness is 12 μm. After that, the resulting products were heated at 100° C. in a drying cabinet, whereby ten heat-sensitive transfer recording medium samples (in the 8 mm-wide ribbon form) for this invention and for comparison were obtained.

| (Coloring material layer coating liquid composition) | |
|---|---|
| Montan wax | 22 parts |
| Paraffin wax | 10 parts |
| Ceresin wax | 20 parts |
| One of the compounds given in Table 1 | 15 parts |
| Carbon black | 18 parts |
| Ethylene-vinyl acetate copolymer | 10 parts |

These heat-sensitive transfer recording medium samples were used to make recordings (printings) on plain paper by using a thermal printer (a heating element density 8 dots/mm thin-film-type serial thermal head-equipped device made on an experimental basis) with an applied energy of 1.0 mJ/dot. This procedure was repeated 1 to 3 times. As the plain paper, commercially available fine paper (Beck smoothness 200 sec) and rough paper (Beck smoothness 39 sec) were used. The reflection densities of printed letters were measured. The results are shown in Table 1.

TABLE 1

| Added cpd. | Classification | Printing paper and transferring number of times: Beck smoothness 200 sec 1st | 2nd | 3rd | Beck smoothness 39 sec 1st | 2nd | 3rd |
|---|---|---|---|---|---|---|---|
| Solsperse 1700 (ICI) | Invention, polyester | 0.85 | 0.84 | 0.80 | 0.90 | 0.94 | 0.91 |
| Sorbitan | Invention, polyhydric alcohol | 0.75 | 0.73 | 0.74 | 0.89 | 0.90 | 0.84 |
| Glycerol monobehenate | Invention, polyhydric alcohol ester | 0.78 | 0.77 | 0.75 | 0.88 | 0.88 | 0.86 |
| N-(4-aminobutyl)-cadaverine | Invention, polyamine | 0.84 | 0.83 | 0.85 | 0.90 | 0.89 | 0.83 |
| Propane-1,3-dicarboxylic acid | Invention, polycarboxylic acid | 0.73 | 0.74 | 0.74 | 0.82 | 0.85 | 0.84 |
| HT-W-85 (Sanwa Kagaku) | Invention, polyamide | 0.85 | 0.84 | 0.81 | 0.93 | 0.91 | 0.85 |
| Placcell 26 (Daicell kagaku) | Invention, polyester | 0.83 | 0.81 | 0.80 | 0.88 | 0.87 | 0.84 |
| Oxidized wax | Comparative compound | 0.68 | 0.64 | 0.66 | 0.90 | 0.44 | 0.43 (uneven) |
| Candellila wax | Comparative compound | 0.54 | 0.42 | 0.39 | 0.89 | 0.62 | 0.61 (uneven) |
| Carnauba wax | Comparative compound | 0.68 | 0.68 | 0.54 | >2.0 | ≈0 | ≈0 |

EXAMPLE 2

On a 3.5 μm-thick polyethylene terephthalate film support was formed a subbing layer having a dry thickness of 1.0 μm by wire-bar coating a solution of a mixture of polyurethane (N-2301, produced by Nippon Polyurethane) with ethylene-ethyl acrylate resin (NUC-6070, produced by Nippon Unicar) in a proportion of 3:1, and on this, after drying, was wire-bar coated the following coloring material layer coating liquids (disperse liquids prepared using a dissolver) so that its thickness is 7 μm. After that, the coated product was heated at 100° C. to be dried in a drying cabinet for 20 minutes, whereby 20 heat-sensitive transfer recording medium samples (in the 8 mm-wide ribbon form) for this invention and for comparison were obtained.

(Coloring material layer coating liquid composition)

| | |
|---|---|
| Ethylene-ethyl acrylate copolymer | 10 parts |
| Carnauba wax | 22 parts |
| Microcrystalline wax | 30 parts |
| One of the compounds given in Table 2 | 30 parts |
| Carbon black | 18 parts |

These heat-sensitive transfer recording medium samples were used to make recordings (printings) on plain paper by using a thermal printer (a heating element density 8 dots/mm thin-film-type serial thermal head-equipped device made on an experimental basis) with an applied energy of 0.85 mJ/dot. This procedure was repeated 1 and 2 times. In addition, as for the plain paper, commercially available fine paper (Beck smoothness 200 sec) and rough paper (Beck smoothness 39 sec) were used. Reflection densities of the printed letters were measured. The results are shown in Table 2.

TABLE 2

| Added cpd. | classification | Printing paper and transferring number of times: Beck smoothness 200 sec 1st | 2nd | Beck smoothness 39 sec 1st | 2nd |
|---|---|---|---|---|---|
| 2-amino-2-ethylpropane-1,3-diol | Invention, complex polar | 0.84 | 0.82 | 0.84 | 0.83 |
| Propylene glycol-dibehenyl ether | Invention, ether linkage | 0.89 | 0.92 | 0.90 | 0.88 |
| Polyglycerol hexastearate (Hexagreen-5S, Nikko Chemicals) | Invention, polar polymer | 0.75 | 0.75 | 0.80 | 0.80 |
| $H_2N(CH_2)_4NH(CH_2)_5NHCOC_{18}H_{37}$ | Invention, complex polar | 0.78 | 0.79 | 0.84 | 0.86 |
| $HOOC(CH_2)_3O(CH_2)_3COOH$ | Invention, complex polar | 0.80 | 0.82 | 0.90 | 0.91 |
| $HOCH_2CH_2OC_{17}H_{35}$ | Invention, complex polar | 0.85 | 0.84 | 0.89 | 0.84 |
| Butyl alcohol | Invention, polyhydric alcohol | 0.84 | 0.88 | 0.88 | 0.90 |
| 1-(2-aminoethyl)piperazine | Invention, polyamine | 0.84 | 0.82 | 0.84 | 0.83 |
| Propane-1,2,3-tricarboxylic acid | Invention, polycarboxylic acid | 0.74 | 0.73 | 0.80 | 0.80 |
| ω-oxydecanoic acid | Invention, complex polar | 0.78 | 0.76 | 0.84 | 0.83 |
| $H_2N(CH_2)_3COOC_{10}H_{21}$ | Invention, | 0.80 | 0.82 | 0.84 | 0.85 |

TABLE 2-continued

| Added cpd. | classification | Printing paper and transferring number of times | | | |
|---|---|---|---|---|---|
| | | Beck smoothness 200 sec | | Beck smoothness 39 sec | |
| | | 1st | 2nd | 1st | 2nd |
| | complex polar | | | | |
| $C_{12}H_{25}O(CH_2)_{10}OCOC_{12}H_{25}$ | Invention, complex polar | 0.85 | 0.86 | 0.89 | 0.84 |
| $HOOCCH_2CHCH_2CONHC_{18}H_{37}$ COOH | Invention, complex polar | 0.74 | 0.72 | 0.81 | 0.84 |
| $HOCH_2CHCH_2OCONHC_{18}H_{37}$ OH | Invention, complex polar | 0.78 | 0.80 | 0.86 | 0.84 |
| Plakcell 240 (Daicell Kagaku) | Invention, polyester | 0.82 | 0.84 | 0.90 | 0.90 |
| HT-W-70b (Sanwa Kagaku) | Invention, polyamide | 0.84 | 0.80 | 0.85 | 0.81 |
| Polyethylene wax | Comparative compound | 0.50 | 0.43 | 0.94 | 0.64 |
| Hoecht X | Comparative compound | 0.64 | 0.62 | 1.00 | 0.79 |
| Candellila wax | Comparative compound | 0.70 | 0.68 | 0.94 | 0.56 |
| Ceresin wax | Comparative compound | 0.73 | 0.65 | 0.92 | 0.68 |

What is claimed is:

1. A repeatedly usable heat sensitive transfer recording medium comprising a support having a subbing layer and a heat fusible coloring material layer provided thereon which contains (a) a colorant; (b) at least one compound selected from the group consisting of an ester of a higher fatty acid containing from 19 to 50 carbon atoms with a polyhydric alcohol, an oxy acid or an amino alcohol, an ester of a higher aliphatic alcohol containing 19 to 50 carbon atoms with a polycarboxylic acid, an oxy acid or a amino acid;

an alkyl ether of a hydroxyl group-containing compound selected from a polyhydric alcohol, an oxy acid and an amino alcohol, which contain from 19 to 50 carbon atoms;

an alkylaryl ether of a hydroxyl group-containing compound selected from a polyhydric alcohol, an oxy acid and an amino alcohol, which contain from 19 to 50 carbon atoms;

an aryl ether of a hydroxyl group-containing compound selected from a polyhydric alcohol, an oxy acid and an amino alcohol, which contain from 19 to 50 carbon atoms;

an amido compound of a higher fatty acid containing from 19 to 45 carbon atoms with an amino group-containing compound selected from a polyamine, an amino alcohol an dan amino acid;

a urethane derivative formed from a higher aliphatic isocyanate containing from 10 to 50 carbon atoms and a hydroxyl group-containing compound selected from a polyhydric alcohol, an oxy acid and an amino alcohol; and a linear polyester formed by polymerizing a two-basic acid and a glycol or lactone; and (c) a component selected from the group consisting of beeswax, insect wax, shellac wax, spermaceti, wool wax, carnauba wax, Japan wax, auriculae wax, esparto wax, candelilla wax, montan wax, ozokerite, ceresin paraffin wax, microcrystalline wax, petroleum, paraffin, Fischer-Tropsch wax, polyethylene wax, and low-molecular weight polyethylenes.

2. The recording medium of claim 1, wherein said subbing layer comprises a resin selected from an acryl resin, an ethylene-vinylacetate resin, a vinylacetate resine, a polyurethane resin, a phenoxy resin, a polyvinylbutyl resin, a polycarbonate resin, a polyester resin, an ethylene-ethylacrylate resin and an epoxy resin.

3. The recording medium of claim 1, wherein said subbing layer comprises at least one resin selected from a polyurethane resin, a phenoxy resin, a polyester resin and a polycarbonate resin and at least one resin selected from a polyvinylacetate resin and polyacrylate resin.

4. The recording medium of claim 1, wherein said compound has a melting point of 40° C. to 120° C.

5. The recording medium of claim 4, wherein said subbing layer comprises at least one resin selected from a polyurethane resin, a phenoxy resin, a polyester resin and a polycarbonate resin and at least one resin selected from a polyvinylacetate resin and a polyacrylate resin.

6. The recording medium of claim 4, wherein said subbing layer comprises a resin selected from an acryl resin, an ethylene-vinylacetate resin, a vinylacetate resin, a polyurethane resin, a phenoxy resin, a polyvinylbutyl resin, a polycarbonate resin, a polyester resin, an ethylene-ethylacrylate resin and an epoxy resin.

7. The recording medium of claim 1, wherein said compound is a linear polyester and the subbing layer is an ethylene-vinyl acetate resin.

8. The recording medium of claim 1, wherein said (c) component is a wax selected from the group consisting of beeswax, insect wax, shellac wax, spermaceti, wool wax, carnauba wax, Japan wax, auriculae wax, esparto wax, candelilla wax, montan wax, ozokerite, ceresin paraffin wax, microcrystalline wax, petrolatum, paraffin, FischerTropsch wax, and polyethylene wax.

9. The recording medium of claim 1 wherein said (c) component is a low-molecular weight polyethylene.

* * * * *